United States Patent [19]

Pongsengsook

[11] Patent Number: 4,600,253

[45] Date of Patent: Jul. 15, 1986

[54] COMBINATION STORAGE DISPLAY AND SERVING UTENSIL

[76] Inventor: Phiraphol Pongsengsook, 493 Sampeng St., Bangkok 10100, Thailand

[21] Appl. No.: 706,324

[22] Filed: Feb. 27, 1985

Related U.S. Application Data

[63] Continuation of Ser. No. 415,136, Sep. 7, 1982, abandoned.

[51] Int. Cl.[4] ..... B65D 21/02

[52] U.S. Cl. ..... 312/284; 206/506

[58] Field of Search ..... 312/284; 206/501, 506, 206/45.2, 508

[56] References Cited

U.S. PATENT DOCUMENTS

| | | | |
|---|---|---|---|
| 2,695,115 | 11/1954 | Roop | 206/508 |
| 3,511,288 | 5/1970 | Swett et al. | 312/284 X |
| 3,815,736 | 6/1974 | Sedlak | 206/501 |

FOREIGN PATENT DOCUMENTS

| | | | |
|---|---|---|---|
| 454732 | 6/1958 | Switzerland | 206/501 |
| 5360 | of 1886 | United Kingdom | 312/284 |

*Primary Examiner*—William E. Lyddane
*Assistant Examiner*—Joseph Falk

[57] ABSTRACT

A combination storage, display and serving utensil with a base having two surfaces, the upper surface being provided with a central raised retaining portion and the under surface having supporting members spaced between the center and the edge of the base and with a bowl-like member having a closed end forming a shoulder, an open end and a sidewall therebetween. A raised knob is provided centrally of the shoulder on the bowl-like member. When the utensil is in its storage and display mode the edges around the open end of the bowl-like member surround the raised retaining portion of the base and when the components are mutually inverted and the utensil is in its serving mode, the shoulder on the closed end of the bowl-like member rests on the supporting members with the open end facing upwardly. A recess or spaced protrusions may be provided in the center of the under surface of the base and when the components are inverted the knob on the bowl-like member is accommodated within the recess or within the area defined by the spaced protrusions.

11 Claims, 9 Drawing Figures

COMBINATION STORAGE DISPLAY AND SERVING UTENSIL

This is a continuation of application Ser. No. 415,136, filed on Sept. 7, 1982, now abandoned.

BACKGROUND OF THE INVENTION

This invention relates to a combination storage, display and serving utensil so constructed that the same components perform a plurality of functions.

Heretofore there have been proposals to provide structures in which storage and display of a product is simultaneously accomplished or structures in which the same components separately perform a storage function and a display function.

One such latter proposal is in U.S. Pat. No. 3,511,288 in which a base member, a plate and a cover member are so constructed that the cover, which is normally disposed over the plate, may be inverted to support the plate thereon so as to display the product on the plate. In that Patent, the base member has a recessed central portion adapted to receive the plate and the cover member has an upwardly raised central portion to provide clearance for the contents of the plate. The base member has a bottom edge portion adapted to interfit with the cover so that the base member can be placed on the cover which then serves as a pedestal to display the product on the plate.

British Pat. No. 11,487 provides a butter cooler in which a base member has a trench for receiving water or ice surrounding a central raised portion. The raised portion carries butter or the like and a cover is disposed thereover.

Cake hives are well known in the art and one early disclosure is found in U.S. Pat. No. 877,796 which shows a cake plate with a cover thereover. The cover has a knob at its top to facilitate handling of the cover.

U.S. Pat. No. 3,819,455 discloses a shield in the form of a cover to be placed over a cake. The shield is provided with apertures to hold candles.

U.S. Pat. No. 4,197,940 includes a central cake tray having a releasable fastening cover. A plate which carries cake or the like is provided with structure with interengages with the supporting cake tray to prevent relative movement therebetween. The cover is disposed over the tray and, allegedly, the cake carried by the plate will not shift position even when the tray is slightly inclined.

U.S. Pat. No. 3,057,671 shows a pie rack provided with trays for storing a stack of pies.

The foregoing patents do not either disclose nor remotely suggest a bowl-like member and base so constructed that an entirely different configuration, having a completely different use, is accomplished by merely inverting both the base and the bowl-like member. Great economy is accomplished by such an arrangement in view of the fact that two components may serve multiple functions without additional expenditure. No structure as provided by the present invention has been heretofore suggested.

SUMMARY OF THE INVENTION

The invention accomplishes the aforesaid highly desirable results by the provision of a base of any desirable shape whose upper surface is provided with a raised central portion interiorally of its edge. A bowl-shaped member, having a cylindrical sidewall, a closed end and an open end, is adapted to fit over the base with the lower edges of the sidewall surrounding its open end fitting around the raised central portion in the base. The closed end of the bowl-shaped member comprises a shoulder portion. A knob is disposed centrally of the shoulders to facilitate the handling of the bowl-shaped member.

The under surface of the base has supporting members and may, if desired, be provided with a central recess or a plurality of spaced protrusions extending from the base. The supporting members are preferably disposed at spaced locations between the center and the outer edge of the base.

When the bowl-like member is disposed over the upper surface of the base with its lower edges located around the raised central portion, the unit functions as a storage and display utensil, such as a cake dish or the like. However, and most uniquely, in accordance with the present invention when the base and the bowl-like member are mutually inverted an entirely different function is accomplished by the same components. The shoulder of the bowl-shaped member rests on the spaced supporting members or supports on the base and out of contact with the base itself.

When the recess is provided in the under surface of the base, the knob disposed substantially centrally of the shoulder of the bowl-shaped member is accommodated in this recess in the base. When spaced protrusions extending from the base are provided, the knob is accommodated within the area defined by the spaced protrusions. In either event, the recess or the spaced protrusions define a dimension slightly larger than the similar dimension of the knob and act as holding means preventing the knob and thereby the bowl-like member from inadvertent movement. The open end of the bowl-shaped member faces outwardly and the utensil by this simple manipulation then functions as a serving utensil such as a salad bowl, fruit bowl or the like.

The following description of the illustrated form of the invention is to facilitate an understanding thereof and is in no way intended to be a limitation upon the scope of the invention.

BRIEF DESCRIPTION OF THE DRAWINGS

FIG. 5 is a perspective view of the base and bowl-like member assembled as a serving utensil, such as a salad bowl or the like;

DETAILED DESCRIPTION OF THE INVENTION

Figure 1:
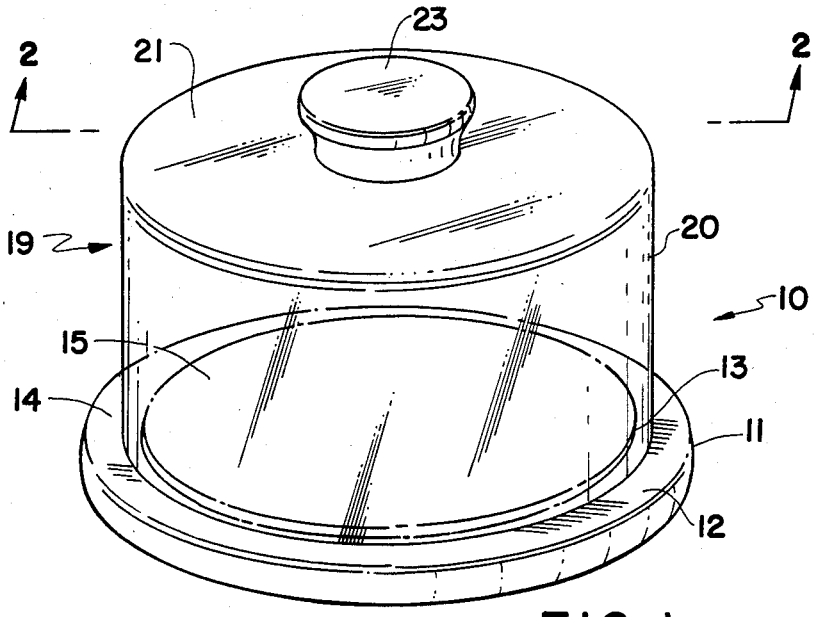
FIG. 1 is a perspective view of the base and bowl-like member of the present invention utilized as a storage and display utensil.
Figure 2:
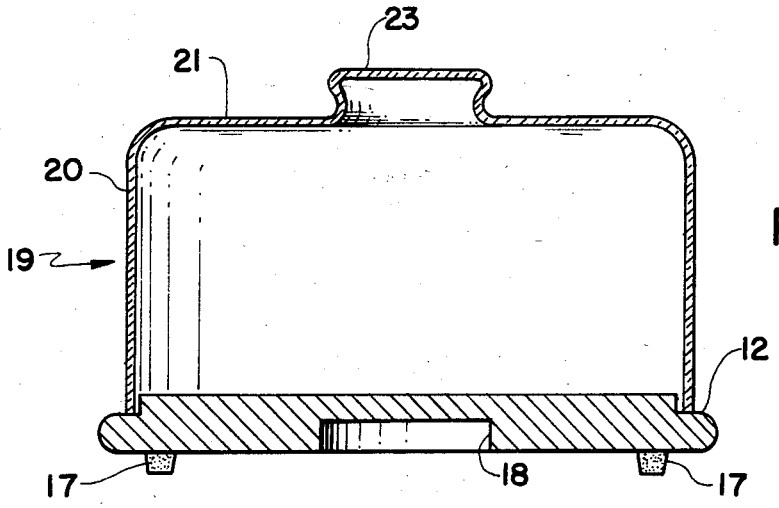
FIG. 2 is a section taken along the lines 2—2 of FIG. 1.
Figure 3:
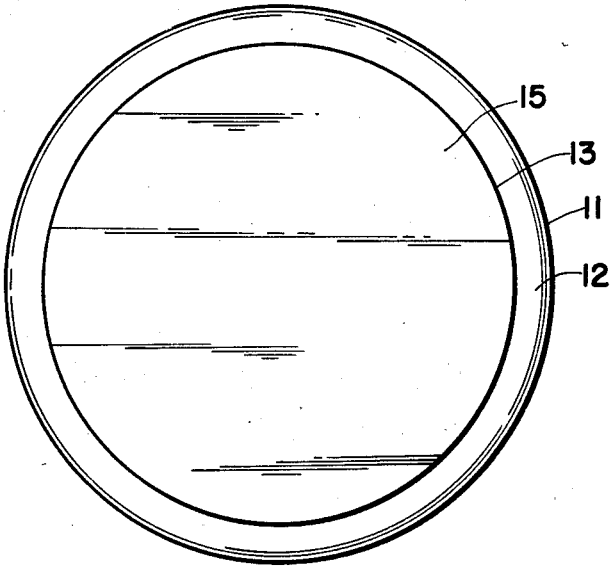
FIG. 3 is a top plan view of the upper surface of the base.
Figure 4:
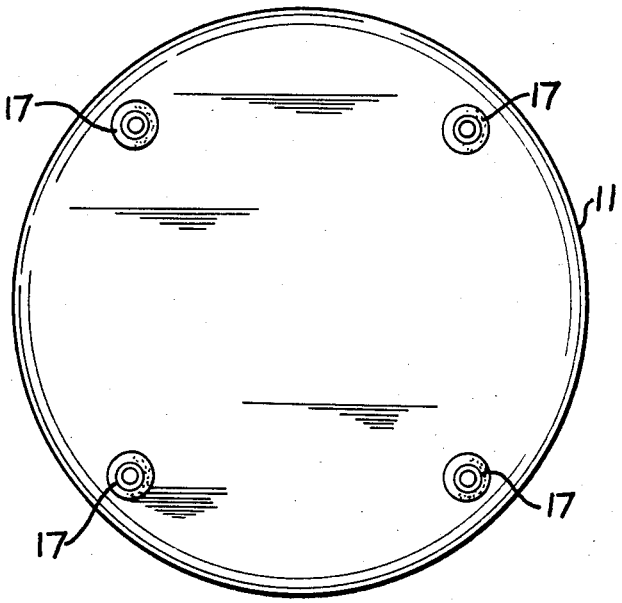
FIG. 4 is a top plan view of the under surface of the base.
Figure 5:
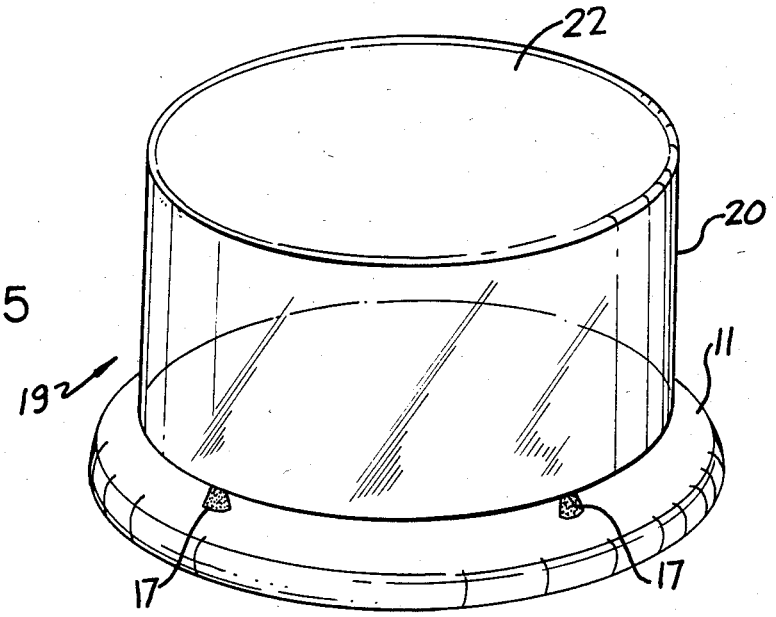
Figure 6:
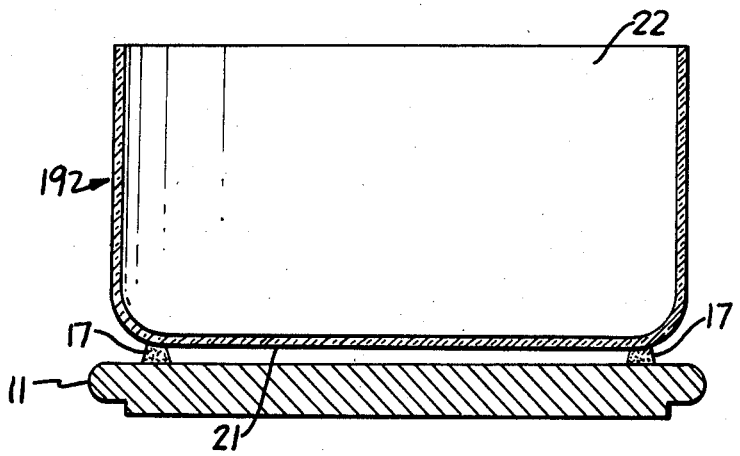
FIG. 6 is a section taken along the lines 6—6 of FIG. 5.

As illustrated, the present invention provides a combination storage, display, and serving utensil 10. One of the components of this utensil is a base 11 having on its upper side 12 a raised central retaining portion 13 is disposed between the edges 14 and the center 15. While the base 11 is illustrated as being circular, it should be understood that the configuration may be rectangular, square, oval, or any other suitable one. The under surface 16 of the base 11 carries individual supporting members or supports 17 which may be of cushioning material such as rubber or felt. The supports 17 are spaced from each other and are located between the edge 14 and the central portion 18 of the under surface of the base. The base 11 is so constructed as to be able to support products for storage and display. As illustrated, the utensil 10 includes a bowl-like member 19 which has a side wall 20, a closed end forming a uniformly continuously extending substantially flat and even shoulder 21 and an open end 22. The bowl-like member is illustrated in circular form although, of course, it may be rectangular, square, oval, or any other shape adapted to cooperatively engage with the base 11.

A raised external knob 23 is disposed centrally of the closed end 21 of the bowl-like member 19 and extends upwardly or outwardly beyond the shoulder 21 in a direction away from the open end 22. The combination utensil 10 has multiple functions. When assembled with the edge surrounding the open end 22 of the bowl-like member 10 fitted around the retaining portion 13 in the base 11 the utensil functions as a storage and display utensil. A cake, pie, pastry or similar product (not shown) may be placed on the base 11 and there stored and displayed. With the base resting in the supports 17 when the bowl-like member 19 is of glass, the condition of the product is in full view. The knob 23 is used to remove the bowl-like member and to replace it when desired.

While the retaining portion of the base has been illustrated and described as a raised central portion, it will be understood that other structure may be utilized, such as, a circumferential groove (not shown) between the center and the outer edge of the base or a raised perimeter portion may be disposed on the base, e.g., a retaining portion forming a perimetric marginal reception seat extending around the peripheral edge portion of the upper surface of the base such that the open edge of the sidewall is fittable therearound and retentively locatable thereon for co-action therewith to inhibit substantially relative lateral movement therebetween.

When the bowl-like member 10 and the base 11 are mutually inverted the shoulder 21 rests on the supports 17 and the open end 22 of the bowl-like member 19 faces upwardly or outwardly. In this position the structure then provides a serving utensil such as a salad bowl, fruit bowl or the like. The supporting members are of a height to minimize contact, if any, between the shoulder 21 and the base 11.

Figure 7:
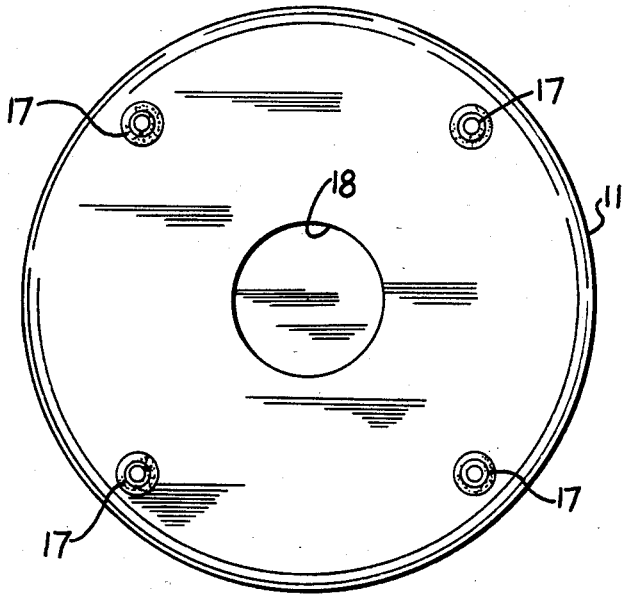
FIG. 7 is a top plan view of the modified form of the under surface of the base having a recess central of its edges.
Figure 8:
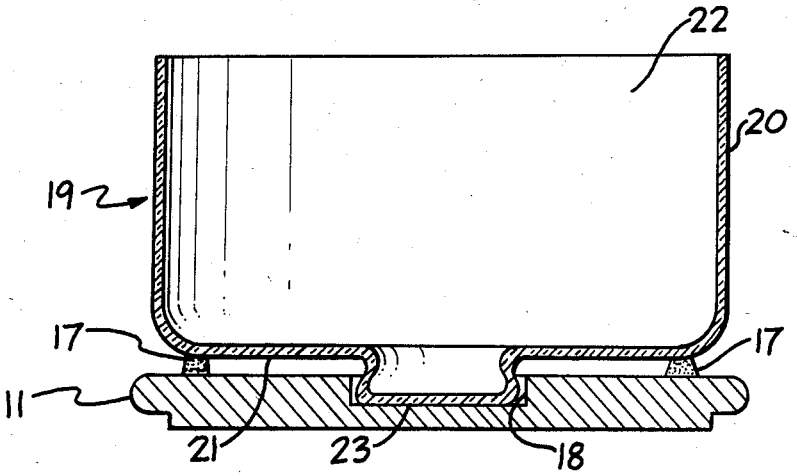
FIG. 8 is a sectional view of the modified form of the present invention showing the components assembled as a serving utensil with the knob on the bowl-like member accommodated in the recess in the base.
Figure 9:
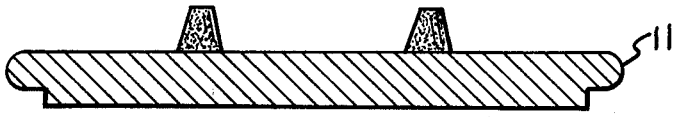
FIG. 9 is a sectional view of another modified form of the invention showing the components assembled as a serving utensil with the knob on the bowl-like member accommodated in the area defined by spaced protrusions extending from the base.

The under surface of the base 11 may be provided, in accordance with the present invention, with holding means for the knob in the form of a central recess 24 as shown in FIGS. 7 and 8. In this event, the dimensions of the knob 23 are slightly less than the corresponding dimensions of the recess 24. The supporting members 17 are then made of such height as to enable the knob 23 to be accommodated within the recess 24 when, as illustrated in FIG. 7, the utensil is in its serving mode.

The under surface of the base may, alternatively be provided with holding means in the form of spaced protrusions 25. The dimension of the spacing between the protrusion presents an area slightly larger than the dimensions of the knob 23. The knob 23 is then accommodated within the area defined by the spaced protrusions 25 and prevented from inadvertent movement.

It is clear from the foregoing that the knob, recess and supporting members are sized and arranged such that the knob is insertable into and retentively locatable in the recess for coaction therewith to inhibit substantially relative lateral movement therebetween, and such that when the knob is so inserted the supporting members are interposed between the under surface of the base and the shoulder of the closed end of the bow-like member and, e.g., in turn contact the shoulder for thereby inhibiting contact between the shoulder and the under surface of the base.

The serving utensil is sturdy and functional. When the bowl-like member is of glass a full view of the contents is always available.

The present invention therefore provides a unique two component utensil which is economical to produce, sturdy, simple to assemble and clean. The manipulation required to provide different functions is merely to mutually invert the two components and needs no additional parts or complex handling.

It will be understood that the foregoing description is merely illustrative of the invention and does not limit the scope thereof as defined in the appended claims.

What is claimed is:

1. Combination storage, display and serving utensil comprising two mutually invertable coacting components including:

(a) as a first component:

a base having an upper surface and an under surface, said upper surface being provided with a peripheral edge portion having a retaining portion forming a perimetric marginal reception seat extending around the peripheral edge portion, and said under surface being provided with a reception recess therein and with support means disposed thereon peripherally outwardly of the recess, and (b) as a second component:

a bowl-like member having a closed end providing a shoulder, an open end, and a sidewall therebetween, said sidewall terminating in an open edge at said open end which is fittable around and retentively locatable on the marginal reception seat of the upper surface of the base for coaction therewith to inhibit substantially relative lateral movement therebetween, and a raised external knob disposed on said closed end and extending outwardly beyond said should in a direction away from said open end, said knob recess and support means being arranged such that said knob is insertable into and retentively locatable in said recess for coaction therewith to inhibit substantially relative lateral movement therebetween, and such that when said knob is inserted into said recess, said support means are interposed between the under surface of the base and the shoulder of the closed end of the bowl-like member, whereby a storage and display utensil is provided when said open edge of the sidewall of the bowl-like member is located on said marginal reception seat of the upper surface of the base, and a serving utensil is provided when the two components are mutually inverted and said knob is inserted into said recess in the under surface of the base.

2. Utensil of claim 1 wherein said support means are arranged such that when the two components are mutually inverted and said knob is inserted into said recess said support means contact the shoulder of the closed end of the bowl-like member and thereby inhibit contact between said shoulder and the under surface of the base.

3. Utensil of claim 2 wherein said support means include cushioning material.

4. Utensil of claim 1 wherein said support means include spaced apart individual support members disposed on the under surface of the base.

5. Utensil of claim 4 wherein said support members are of cushioning material.

6. Utensil of claim 1 wherein said knob is disposed substantially central of the closed end of the bowl-like member and said recess is correspondingly disposed substantially central of the base.

7. Utensil of claim 1 wherein the base and the bowl-like member are substantially circular in shape.

8. Combination storage, display and serving utensil comprising two mutually invertable coaction components including:

(a) as a first component:

a base having an upper surface and an under surface, said upper surface being provided with a peripheral edge portion having a retaining portion forming a perimetric marginal reception seat extending around the peripheral edge portion, and said under surface being provided with a reception recess therein and with spaced apart individual raised support members disposed thereon peripherally outwardly of the recess, and (b) as a second component:

a bowl-like member having a closed end providing a shoulder, an open end, and a sidewall therebetween, said sidewall terminating in an open edge at said open end which is fittable around and retentively locatable on the marginal reception seat of the upper surface of the base for coaction therewith to inhibit substantially relative lateral movement therebetween, and a raised external knob disposed on said closed end and extending outwardly beyond said should in a direction away from said open end, said knob, recess and support members being sized and arranged such that said knob is insertable into and retentively locatable in said recess for coaction therewith to inhibit substantially relative lateral movement therebetween, and such that when said knob is inserted into said recess said support members are interposed between the under surface of the base and the shoulder of the closed end of the bowl-like member and in turn contact said shoulder and thereby inhibit contact between said shoulder and the under surface of the base, whereby a storage and display utensil is provided when said open edge of the sidewall of the bowl-like member is located on said marginal reception seat of the upper surface of the base, and a serving utensil is provided when the two components are mutually inverted and said knob is inserted into said recess in the under surface of the base and said support members are in contact with said shoulder.

9. Utensil of claim 8 wherein said support members are of cushioning material.

10. Utensil of claim 8 wherein said knob is disposed substantially central of the closed end of the bowl-like member and said recess is correspondingly disposed substantially central of the base.

11. Utensil of claim 8 wherein the base and the bowl-like member are substantially circular in shape.

* * * * *